US007195127B2

(12) United States Patent
Hsu et al.

(10) Patent No.: US 7,195,127 B2
(45) Date of Patent: Mar. 27, 2007

(54) COLLAPSIBLE CONTAINER

(75) Inventors: Roger S. Hsu, Torrance, CA (US); Justin M. Smyers, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 203 days.

(21) Appl. No.: 10/438,591

(22) Filed: May 13, 2003

(65) Prior Publication Data

US 2004/0226945 A1 Nov. 18, 2004

(51) Int. Cl.
*B65D 6/00* (2006.01)
*B65D 8/14* (2006.01)

(52) U.S. Cl. ..... 220/6

(58) Field of Classification Search ..... 220/4.28, 220/6, 7, 4.22, 4.23, 4.34, 810, 824, 836, 220/840; 206/577; 16/244, 356, 386, 221, 16/239, 319, 363
See application file for complete search history.

(56) References Cited

U.S. PATENT DOCUMENTS

| | | | | |
|---|---|---|---|---|
| 1,689,217 | A | 10/1928 | White | |
| 1,809,523 | A | 6/1931 | McLean | |
| 2,760,669 | A | 8/1956 | Kreutzer | |
| 3,000,049 | A * | 9/1961 | Terry, Jr. | 16/334 |
| 3,360,180 | A | 12/1967 | Venturi | |
| 3,446,415 | A | 5/1969 | Bromley | |
| 3,591,212 | A | 7/1971 | Rhyne | |
| 3,853,238 | A | 12/1974 | Luisada et al. | |
| 3,874,546 | A | 4/1975 | Sanders et al. | |
| 3,941,271 | A | 3/1976 | Zargas et al. | |
| 3,951,265 | A | 4/1976 | Carroll | |
| 3,970,209 | A | 7/1976 | Baxter | |
| 4,106,623 | A | 8/1978 | Carroll | |
| 4,109,791 | A | 8/1978 | Clipson et al. | |
| 4,148,407 | A | 4/1979 | Sinclair | |
| 4,186,841 | A | 2/1980 | Buckley et al. | |
| 4,391,369 | A | 7/1983 | Stahl et al. | |
| 4,423,813 | A | 1/1984 | Kreeger et al. | |
| 4,573,577 | A | 3/1986 | Miller | |
| 4,591,065 | A | 5/1986 | Foy | |
| 4,630,745 | A * | 12/1986 | Shiotani | 220/6 |
| 4,735,330 | A | 4/1988 | Hoss | |
| 4,887,874 | A | 12/1989 | Joffe | |
| 4,905,833 | A | 3/1990 | Kreeger et al. | |
| 4,917,255 | A | 4/1990 | Foy et al. | |
| 4,923,079 | A | 5/1990 | Foy | |
| 4,960,223 | A | 10/1990 | Chiang et al. | |
| 5,038,953 | A * | 8/1991 | Radar | 220/6 |

(Continued)

FOREIGN PATENT DOCUMENTS

| | | |
|---|---|---|
| DE | 1536040 | 10/1966 |

(Continued)

*Primary Examiner*—Anthony D. Stashick
*Assistant Examiner*—Harry A. Grosso

(57) ABSTRACT

The collapsible container includes a plurality of side walls connected via hinges to a base. The side walls are moveable about the hinges between a collapsed position on the base and an upright, use position generally perpendicular to the base. Each of the hinges includes a hinge pin rotatably received within a hinge receiver. Each hinge pin includes at least one radial projection that abuts a portion of the hinge receiver when the side wall is in the upright position. The radial projection resists over rotation of the side wall and prevents the hinge pin from leaving the hinge receiver during the application of an over rotation force.

22 Claims, 15 Drawing Sheets

U.S. PATENT DOCUMENTS

| | | | | | |
|---|---|---|---|---|---|
| 5,094,356 | A | | 3/1992 | Miller | |
| 5,161,709 | A | | 11/1992 | Oestreich, Jr. | |
| 5,332,114 | A | | 7/1994 | Sano et al. | |
| 5,398,834 | A | | 3/1995 | Umiker | |
| 5,398,835 | A | | 3/1995 | Blinstrub | |
| 5,467,885 | A | | 11/1995 | Blinstrub | |
| 5,494,163 | A | | 2/1996 | Apps | |
| 5,515,987 | A | * | 5/1996 | Jacques et al. | 220/6 |
| 5,538,153 | A | | 7/1996 | Marovskis et al. | |
| 5,586,675 | A | | 12/1996 | Borsboom et al. | |
| 5,588,549 | A | | 12/1996 | Furtner | |
| 5,632,392 | A | | 5/1997 | Oh | |
| 5,671,857 | A | | 9/1997 | Stromberg | |
| 5,797,508 | A | | 8/1998 | Loftus et al. | |
| 5,829,617 | A | * | 11/1998 | Umiker | 220/6 |
| 5,853,099 | A | | 12/1998 | Lessard | |
| 5,860,527 | A | | 1/1999 | Frankenberg et al. | |
| 5,938,059 | A | | 8/1999 | Luburic | |
| 5,975,324 | A | | 11/1999 | Schmitt | |
| 6,015,056 | A | | 1/2000 | Overholt et al. | |
| 6,029,840 | A | | 2/2000 | Brauner | |
| 6,073,790 | A | | 6/2000 | Umiker | |
| 6,098,827 | A | | 8/2000 | Overholt et al. | |
| 6,138,851 | A | * | 10/2000 | Townson | 220/6 |
| 6,142,329 | A | | 11/2000 | Dotan | |
| 6,209,742 | B1 | | 4/2001 | Overholt et al. | |
| D446,392 | S | | 8/2001 | Overholt et al. | |
| 6,286,701 | B1 | * | 9/2001 | Umiker | 220/6 |
| 6,290,081 | B1 | | 9/2001 | Merey | |
| 6,293,418 | B1 | | 9/2001 | Ogden et al. | |
| D452,614 | S | | 1/2002 | Overholt | |
| 6,386,388 | B1 | | 5/2002 | Overholt | |
| D458,753 | S | | 6/2002 | Overholt et al. | |
| 6,398,054 | B1 | | 6/2002 | Overholt et al. | |
| 6,405,888 | B1 | | 6/2002 | Overholt et al. | |
| 6,409,041 | B1 | | 6/2002 | Overholt et al. | |
| 6,446,825 | B1 | * | 9/2002 | Godoy | 220/6 |
| 6,460,717 | B1 | | 10/2002 | Smyers et al. | |
| 6,631,822 | B1 | | 10/2003 | Overholt | |
| 6,669,044 | B2 | * | 12/2003 | Murakami et al. | 220/6 |
| 2002/0108950 | A1 | | 8/2002 | Moorman et al. | |
| 2003/0116564 | A1 | | 6/2003 | Overholt et al. | |
| 2003/0132228 | A1 | | 7/2003 | Apps et al. | |
| 2003/0155275 | A1 | | 8/2003 | Apps et al. | |

FOREIGN PATENT DOCUMENTS

| | | | | |
|---|---|---|---|---|
| DE | 1296563 | | | 5/1969 |
| DE | 2033724 | | | 7/1970 |
| DE | 1586980 | | | 9/1970 |
| DE | 91 03 975.4 | | | 3/1991 |
| DE | 92 17 305 | U | | 3/1993 |
| DE | 199 39 019 | A1 | | 2/2001 |
| EP | 0 073 357 | | | 3/1983 |
| EP | 0 690 003 | | | 1/1996 |
| EP | 0 705 764 | A2 | | 4/1996 |
| EP | 0 785 142 | A1 | | 7/1997 |
| EP | 0 962 394 | A1 | | 12/1999 |
| EP | 0 962 396 | A1 | | 12/1999 |
| EP | 1 114 779 | A2 | | 7/2001 |
| EP | 1 160 169 | A2 | | 12/2001 |
| EP | 1 182 139 | A2 | | 2/2002 |
| FR | 1040163 | | | 10/1953 |
| FR | 2 701 690 | | | 2/1993 |
| FR | 2 702 198 | | | 3/1993 |
| GB | 1215049 | | | 12/1970 |
| GB | 2139189 | | | 11/1984 |
| JP | 11 147524 | | | 6/1999 |
| JP | 2001130554 | A | * | 5/2001 |
| SU | 1533952 | | | 1/1990 |
| WO | WO 97/49613 | | | 12/1996 |
| WO | WO 97 49613 | | | 12/1997 |
| WO | WO 00/27716 | A1 | | 5/2000 |
| WO | WO 00/66440 | A1 | | 11/2000 |
| WO | WO 02/06128 | A1 | | 1/2002 |
| WO | WO 02/034630 | | | 5/2002 |
| WO | WO 03/043911 | A | | 5/2003 |
| WO | WO03043911 | A1 | * | 5/2003 |
| WO | WO 03/101846 | A1 | | 12/2003 |

* cited by examiner

COLLAPSIBLE CONTAINER

BACKGROUND OF THE INVENTION

This present invention relates generally to collapsible containers and more particularly to an improved hinge for such containers.

Collapsible containers typically have a base to which four side walls are connected via hinges. The side walls are pivotable about the hinges between a collapsed position and an upright, use position, generally perpendicular to the base. Collapsible containers usually include a latch or interference fit connecting adjacent side walls in the corners to keep the side walls in the upright, use position.

The hinges connecting the side walls to the base often include a hinge pin rotatably received in a hinge receiver. In at least one known container, if excessive outward force is applied on a side wall already in the upright position, the hinge pins may be forced out of the hinge receivers, disconnecting the side wall from the container.

SUMMARY OF THE INVENTION

The collapsible container of the present invention provides improved hinges that resist over rotation and prevent the hinge pins from being released from the hinge receivers in response to excessive over rotation force.

The collapsible container of the present invention includes a plurality of side walls connected via hinges to a base. The side walls are moveable between a collapsed position on the base and an upright, use position, generally perpendicular to the base. Each of the hinges includes a hinge pin rotatably received in a hinge receiver. In a preferred embodiment, each hinge pin includes at least one radial projection that abuts a portion of the hinge receiver when the side wall is in the upright position. The projection resists over rotation and prevents the hinge pin from popping out of the hinge receiver even when an over rotation force is applied to the side wall.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
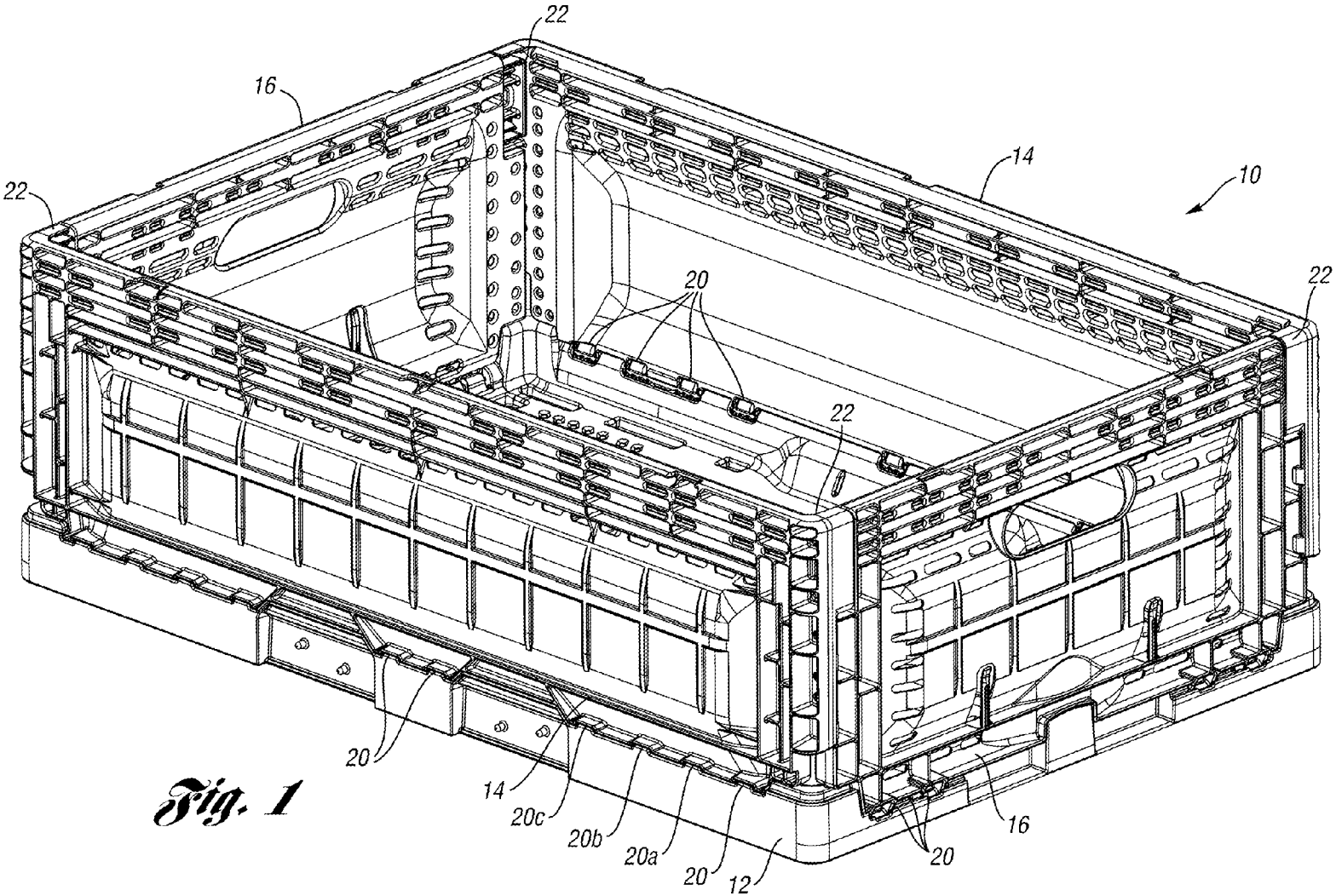
FIG. 1 is a perspective view of the collapsible container of the present invention with the side walls in the upright, use position.

FIG. 1 illustrates a collapsible container 10 according to the present invention. The collapsible container 10 includes a base 12 to which a pair of opposed side walls 14 and a pair of opposed end walls 16 are connected via hinges 20, including hinges 20*a*, 20*b* and 20*c*, which are described in more detail below as representative of all of the hinges 20. Unless otherwise specified, the term "side wall" below is intended to include any of the side walls 14 or end walls 16. In FIG. 1, the side walls 14, 16 are shown in their upright, use position, where adjacent side walls 14, 16 are connected via latches 22 in the corners.

Figure 2:
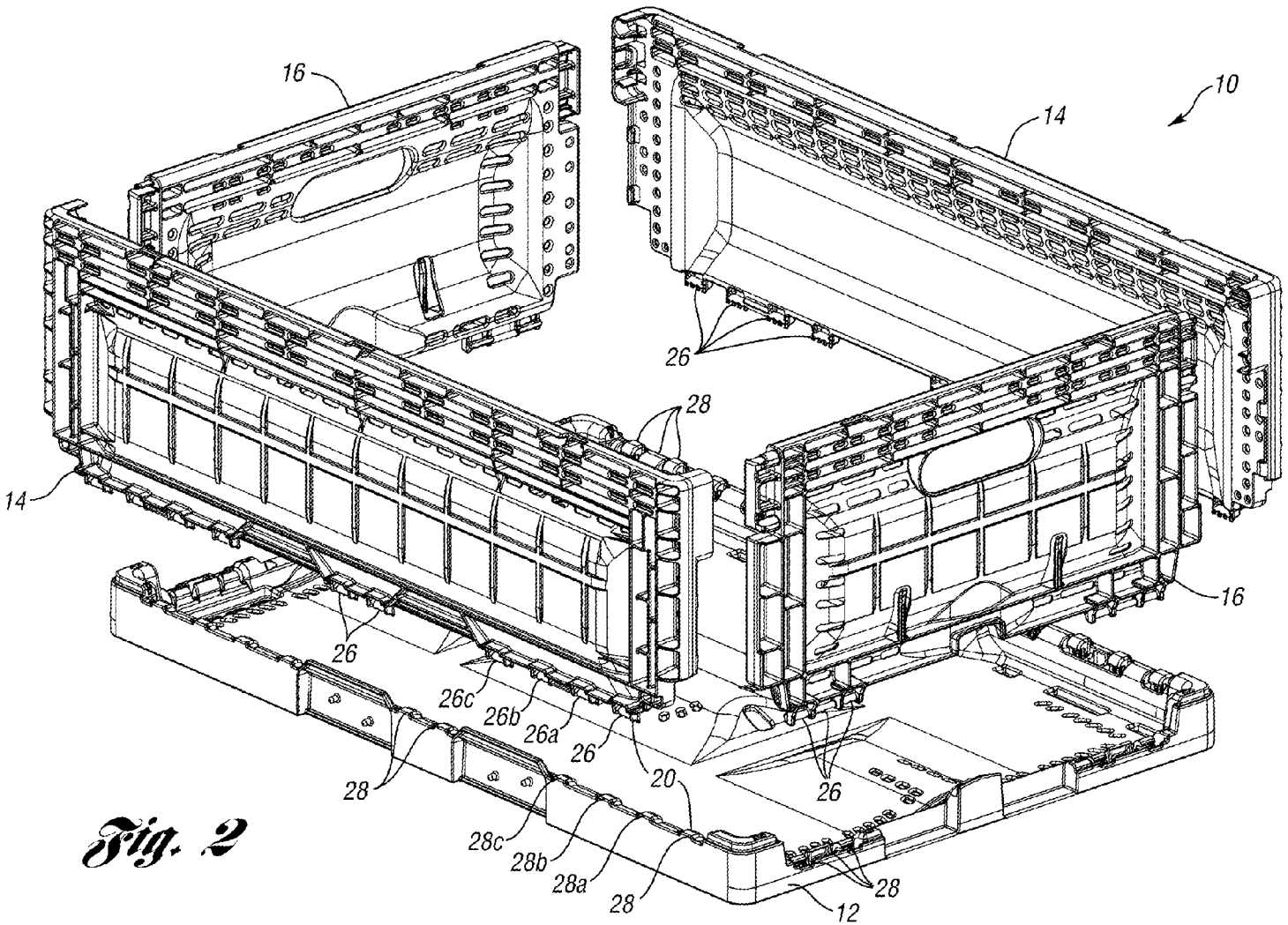
FIG. 2 is an exploded perspective view of the container of FIG. 1.

FIG. 2 is an exploded view of the collapsible container 10 of FIG. 1. Each of the hinges 20 includes a hinge member 26 and hinge receiver 28. For each hinge 20, the hinge member 26 is shown mounted on the side wall 14, 16, while the hinge receiver 28 is shown mounted to the base 12; however, it should be understood that these locations could be reversed for any or all of hinges 20.

Figure 3:
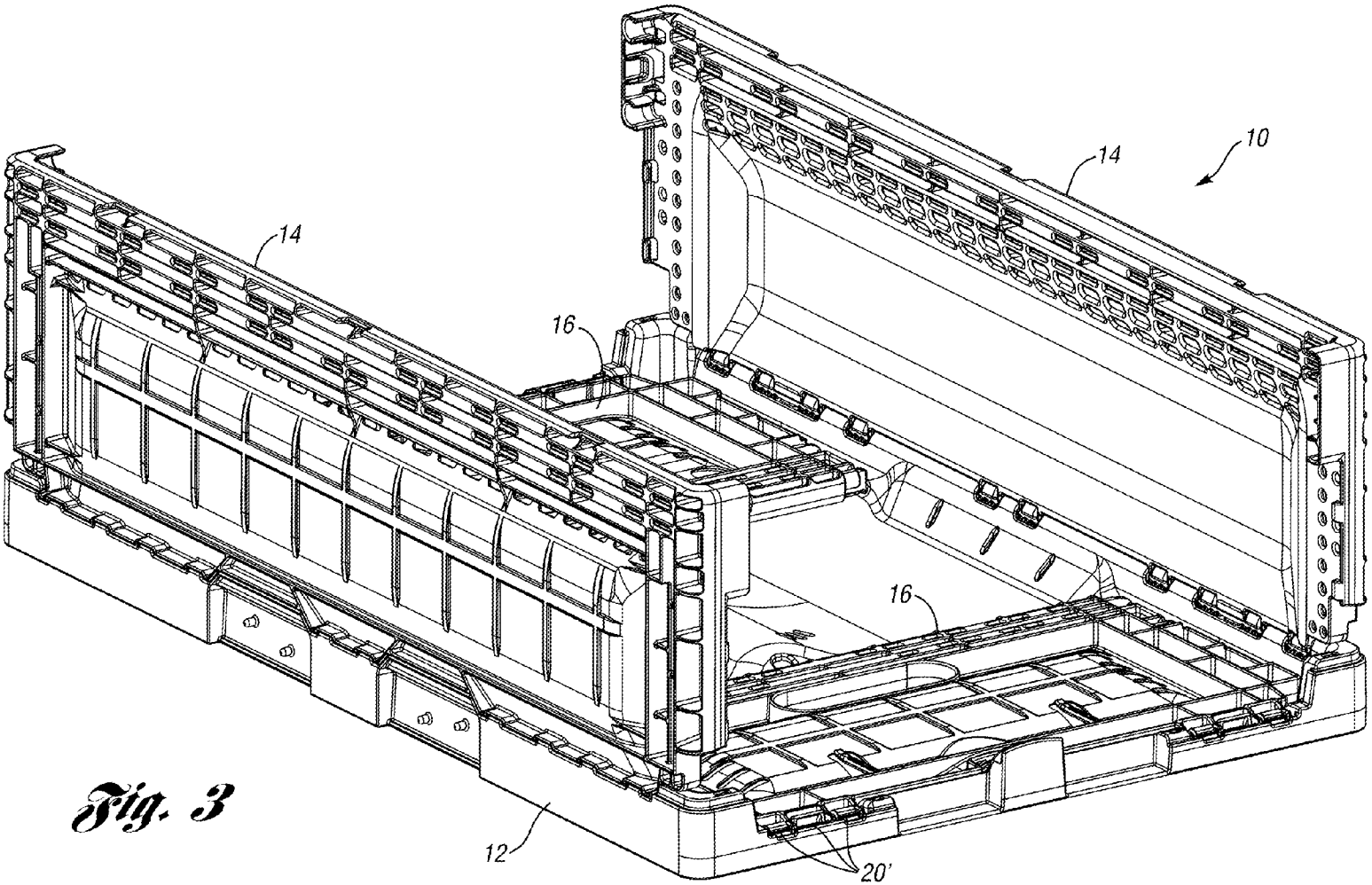
FIG. 3 is the collapsible container of FIG. 1 showing two of the side walls in the collapsed position.
Figure 4:
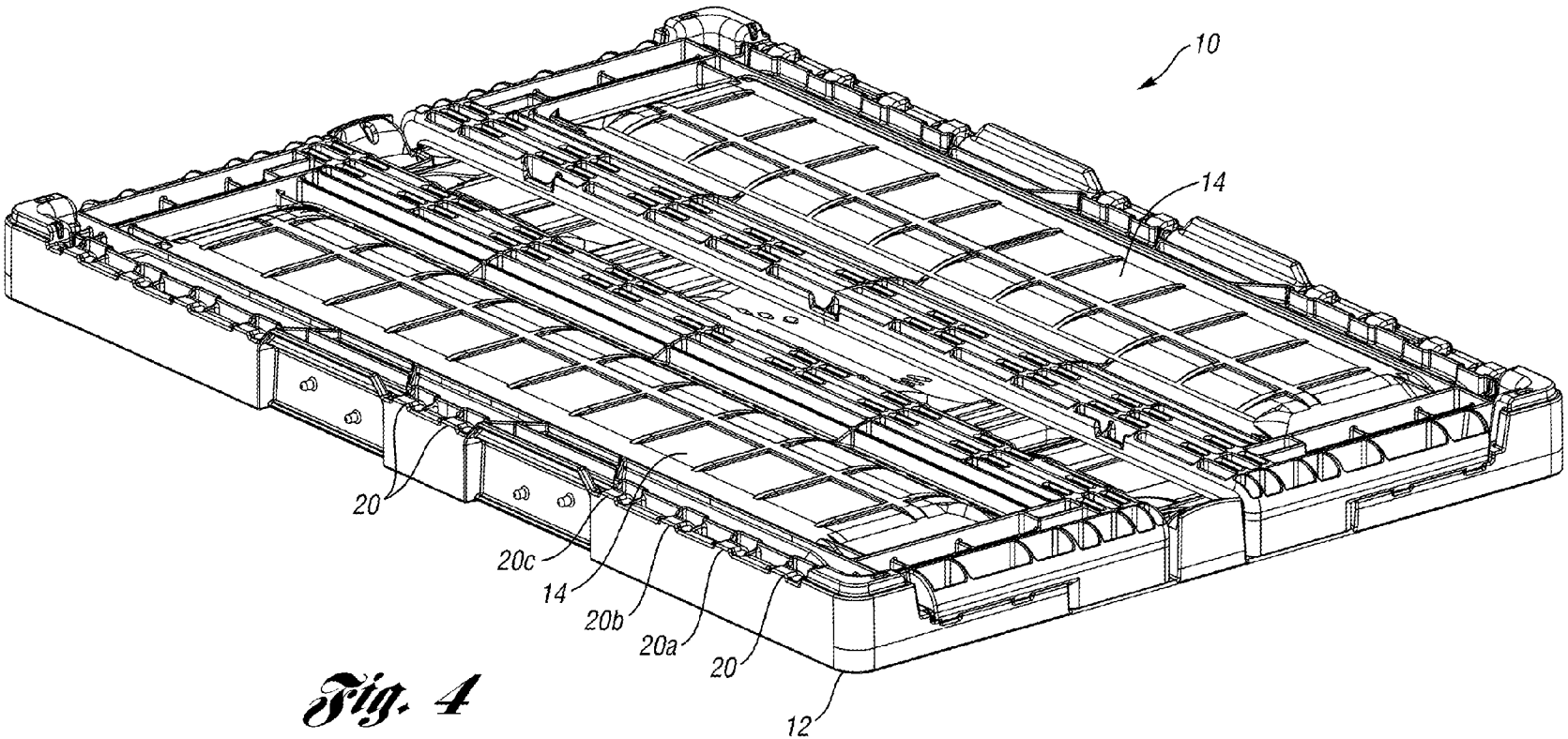
FIG. 4 is the collapsible container of FIG. 1 with all of the side walls in the collapsed position.

The side walls 16 are moveable about the hinges 20 between the upright position shown in FIG. 1 and a collapsed position on the base 12, as shown in FIG. 3. Similarly, the side walls 14 are moveable about the hinges 20 between the upright position shown in FIG. 3 to a collapsed position on the base 12 as shown in FIG. 4.

Figure 5:
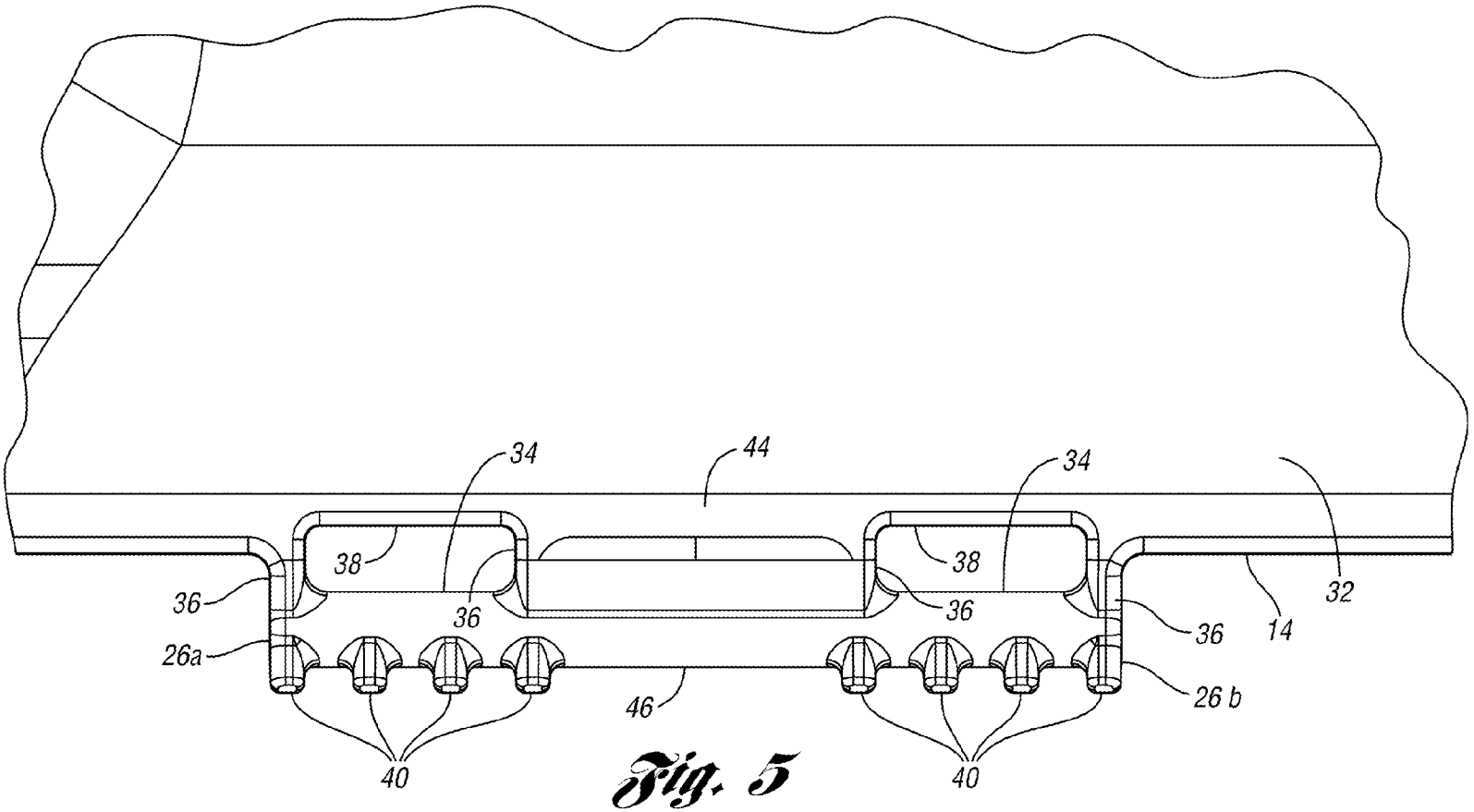
FIG. 5 is an enlarged interior view of two of the hinge pins on one of the side walls.
Figure 6:
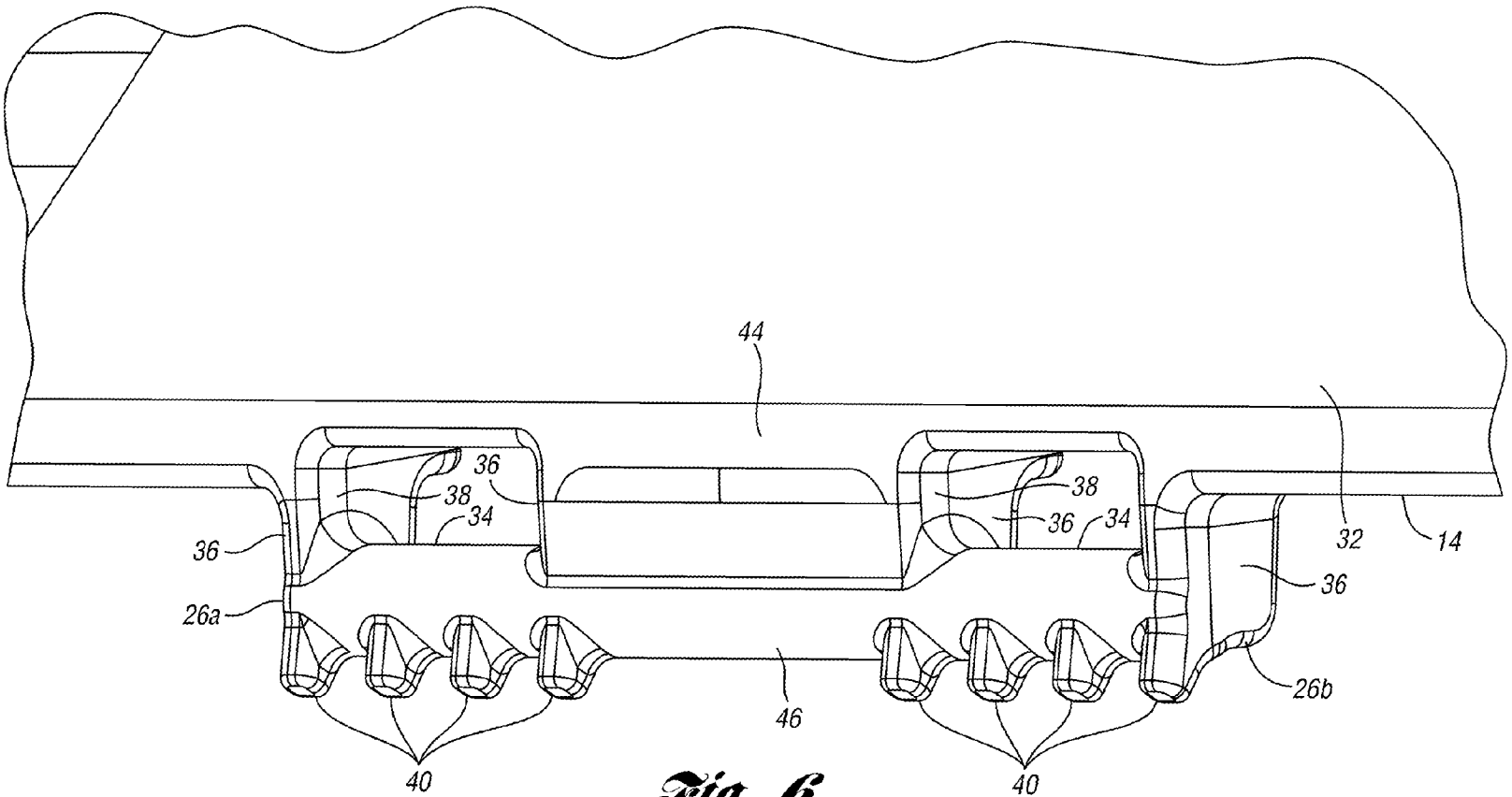
FIG. 6 is a perspective interior view of the hinge pins of FIG. 5.

FIGS. 5 and 6 are enlarged views of hinge members 26*a, b* as viewed adjacent an interior surface 32 of side wall 14. Each hinge member 26*a, b* includes a hinge pin 34 mounted between the ribs 36 extending from a lower edge of the side wall 14. An opening 38 is defined among the side wall 14, hinge pin 34 and ribs 36. Each of the hinge pins 34 includes a plurality of radial projections 40, extending downwardly and slightly inwardly from the hinge pins 34. In the embodiment shown, each hinge pin 34 includes four radial projections 40, but any number could be used. A support 44 extends downward from the side wall 14 between the hinge members 26*a* and 26*b* and connects to a generally cylindrical support surface 46, which is generally coaxial and continuous with the hinge pins 34.

Figure 6A:
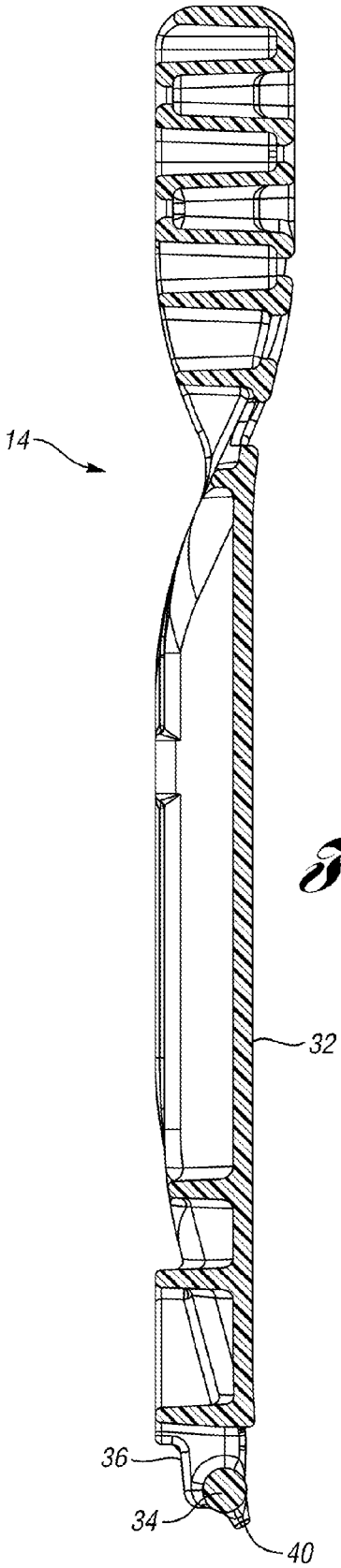
FIG. 6A is a side view of the side wall shown in FIG. 6.
Figure 6B:
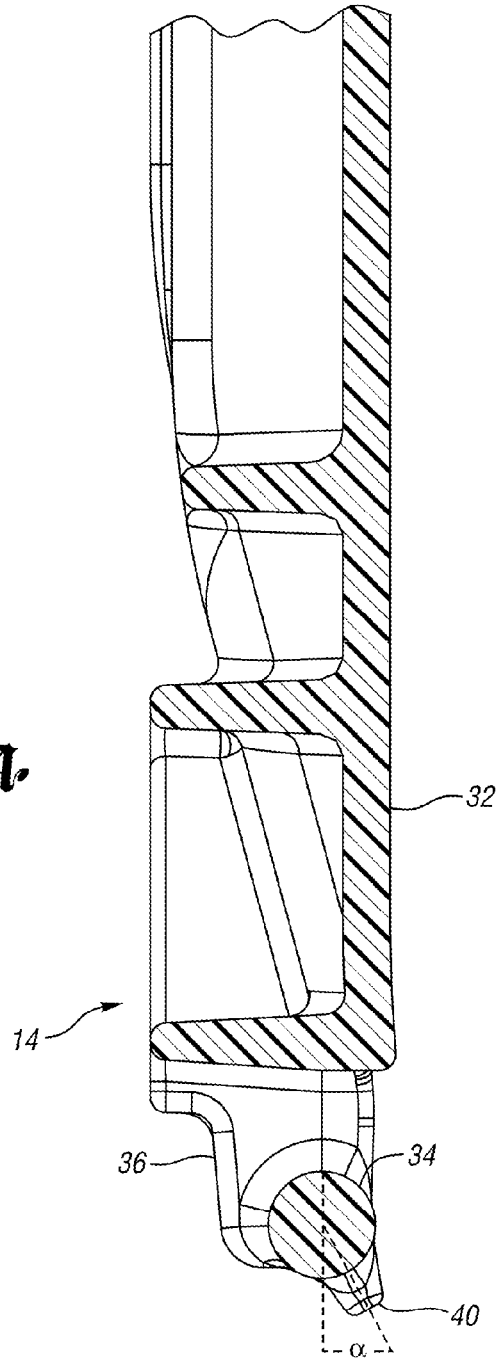
FIG. 6B is an enlarged view of the lower end of the side wall of FIG. 6A.

FIG. 6A is a side view of the side wall 14 shown in FIG. 6. Each radial projection 40 extends downwardly and inwardly from the hinge pin 34. Referring to FIG. 6B, each radial projection 40 extends downwardly and approximately thirty degrees inwardly from the vertical, as indicated by the angle $\alpha$.

Figure 7:
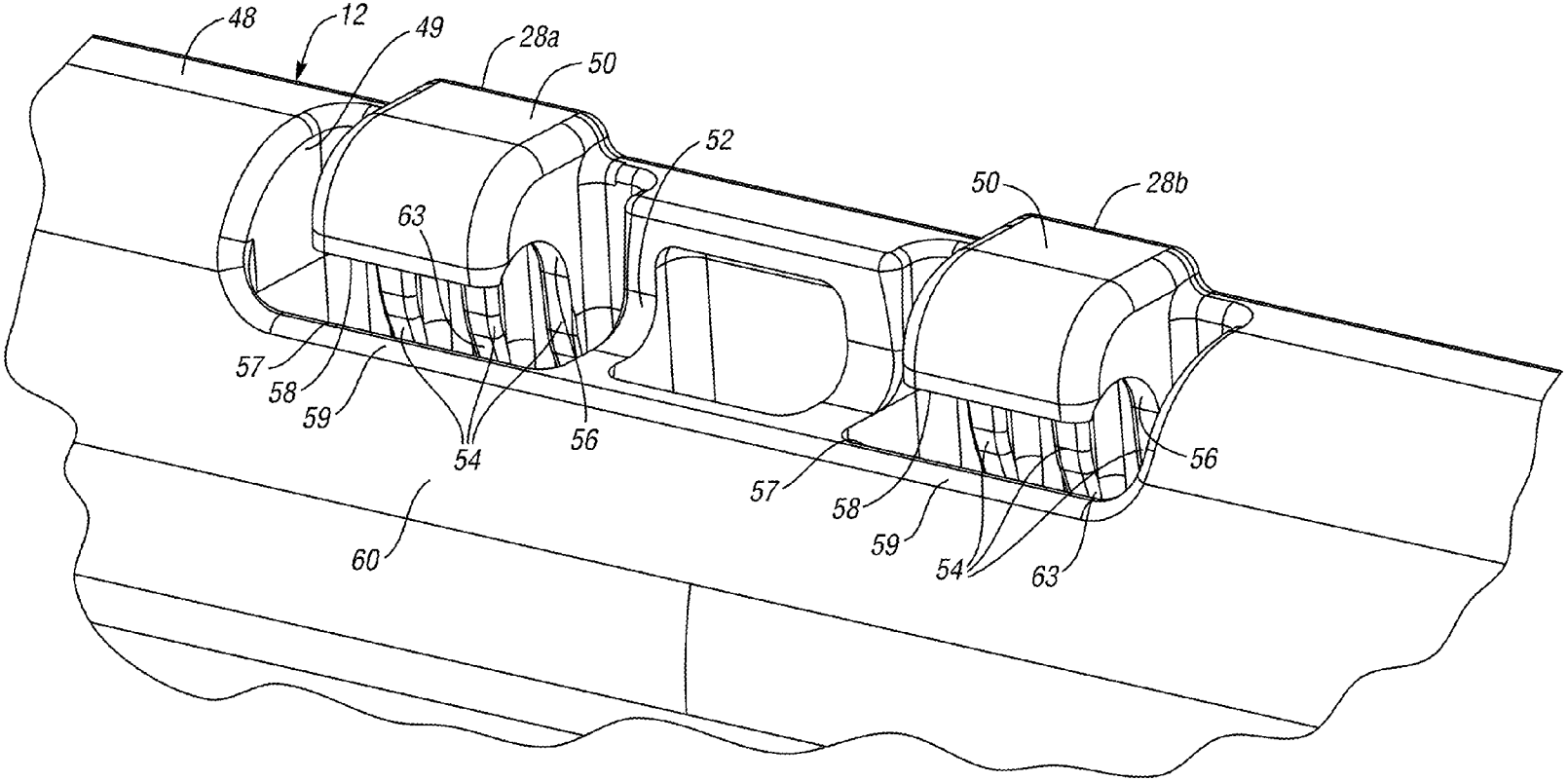
FIG. 7 is a perspective, interior view of two hinge receivers for receiving the hinge pins of FIGS. 5 and 6.

FIG. 7 is an interior, perspective view of the hinge receivers 28*a* and 28*b* of FIG. 1. A flange 48 extending upward from the base 12 includes a recess 49 in which the hinge receivers 28*a, b* are formed. Each hinge receiver 28*a, b* includes a retainer 50. Between the hinge receivers 28*a, b* is a generally concave hinge support surface 52. Each of the hinge retainers 50 includes a plurality of ribs 54 extending upwardly and then inwardly to form an upper, concave surface 56. An opening 57 is defined between an inner lower edge of the retainer 50 and an upper edge 59 of an interior wall 60 of the flange 48 of the base 12. A cavity 63 is defined between the interior wall 60 and the retainer 50.

Figure 8:
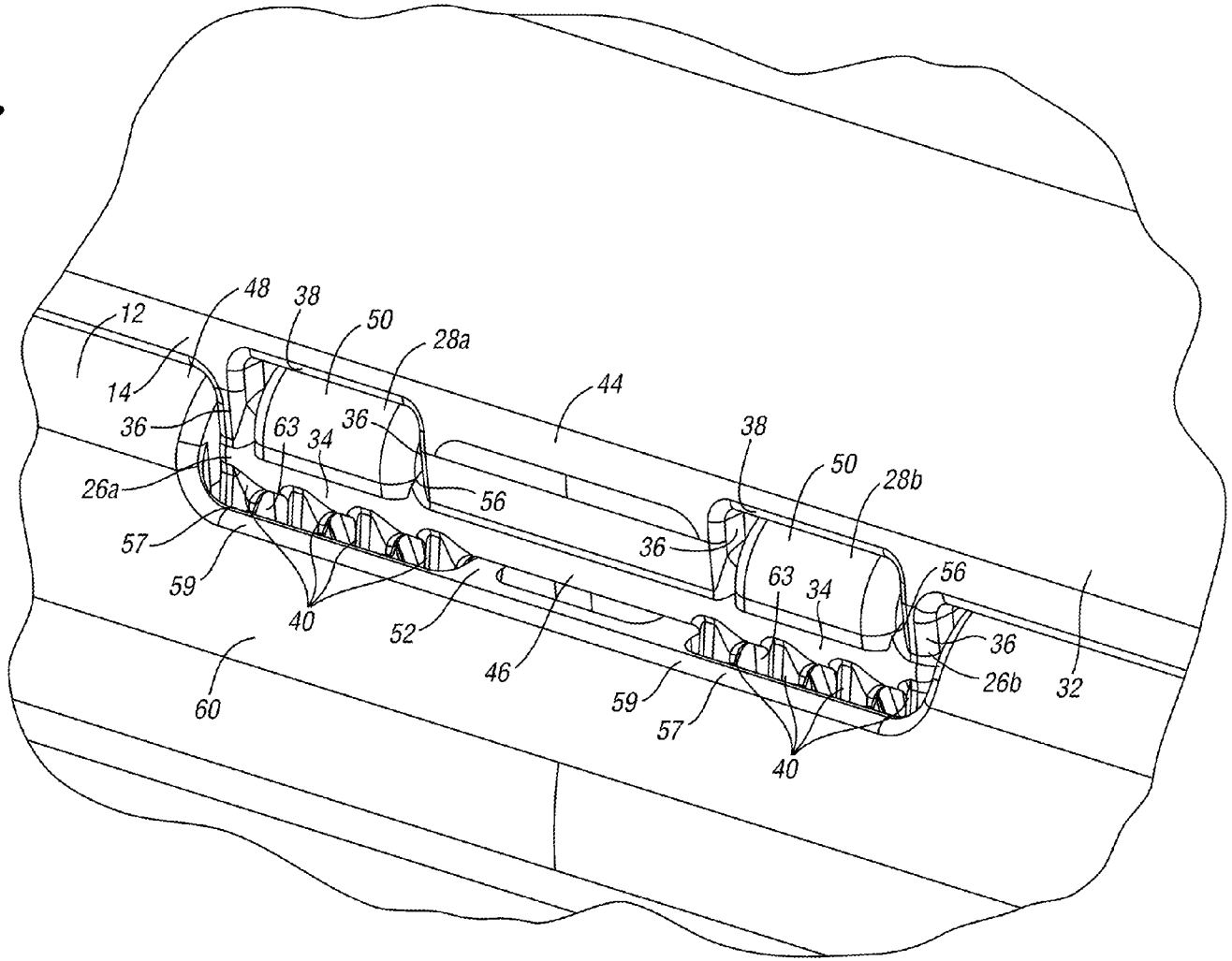
FIG. 8 is an interior perspective view of the hinge pins of FIG. 5 received in the hinge receivers of FIG. 7.

FIG. 8 is an interior view of the hinge members 26*a* and 26*b* assembled into the hinge receivers 28*a* and 28*b*. In the assembled position, the ribs 36 are disposed on either side of the hinge retainers 50. The hinge pins 34 are rotatably received below the hinge retainers 50, such that their upper surfaces abut the concave surfaces 56 on the underside of the hinge retainers 50. The radial projections 40 are trapped in the cavity 63 behind the upper edge 59 of the interior wall 60 of the flange 48 on the base 12, such that lateral surfaces of the radial projections 40 abut the edge 59. The side wall 14 is supported by the surface 46 resting on the hinge support surface 52 between the hinge receivers 28*a, b*. In the assembled position shown in FIG. 8, over rotation of the side wall 14 is resisted by the radial projections 40, which contact the upper edge 59 of the interior wall 60. Further, the radial projections 40, by contacting the upper edge 59 of the interior wall 60, prevent the hinge pin 34 from popping out of the hinge retainer 50.

Figure 9:
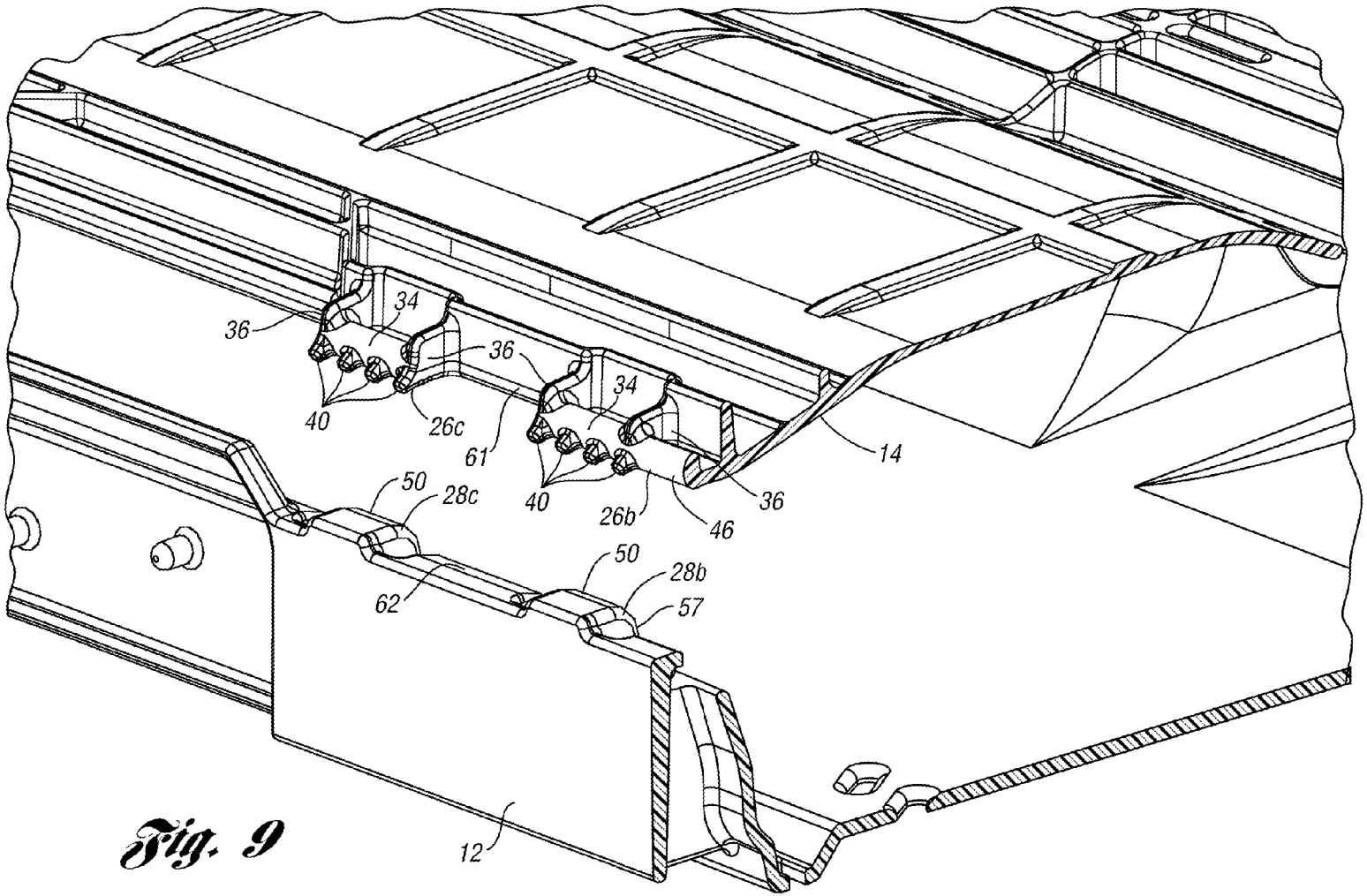
FIG. 9 is an exterior perspective exploded view, partially broken away between the hinge pins in FIG. 5.
Figure 10:
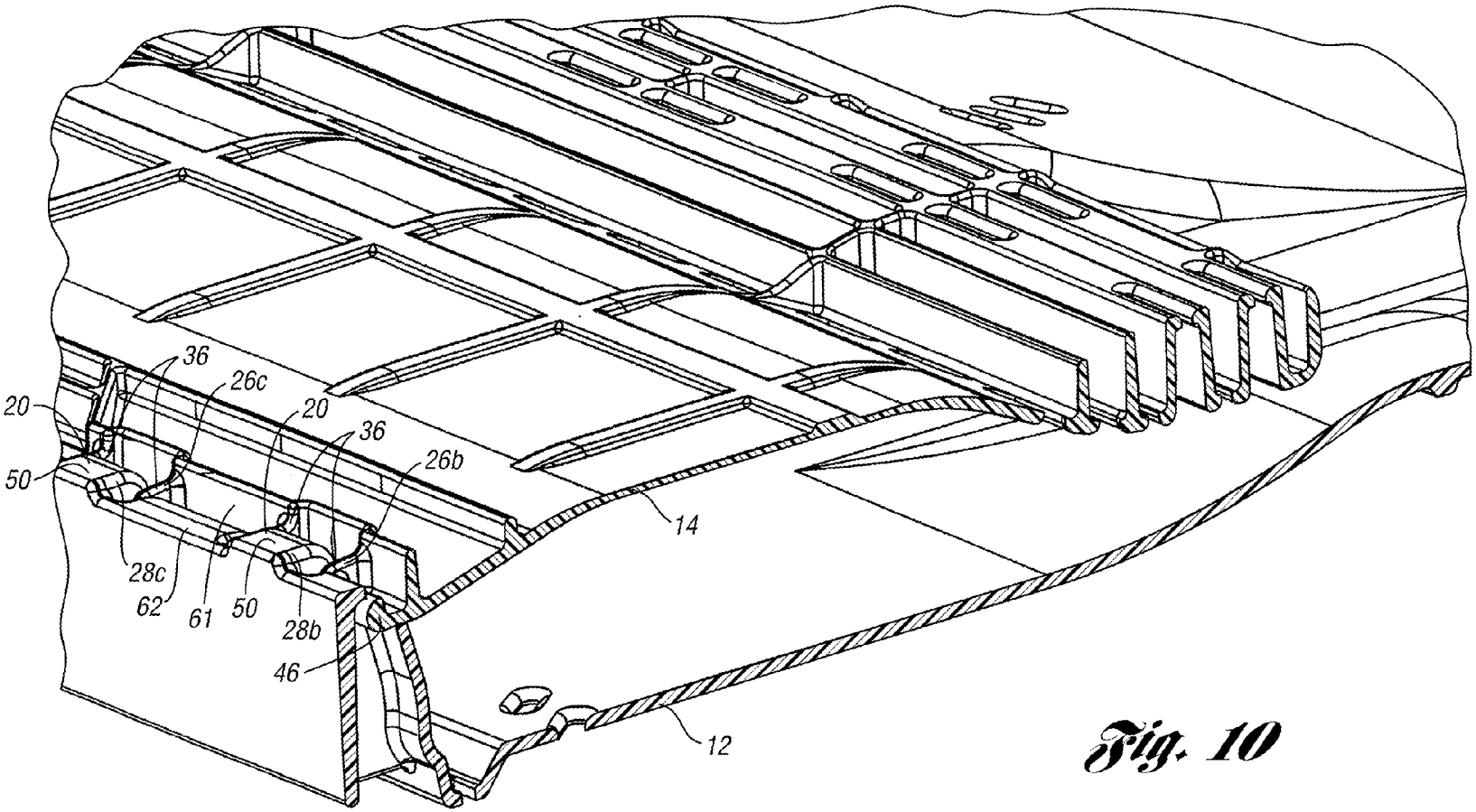
FIG. 10 illustrates the hinge pins and hinge receivers of FIG. 9 in the assembled position.

FIG. 9 illustrates the hinge members 26*b* and 26*c* of FIG. 1. Again, each of the hinge members includes a hinge pin 34 between ribs 36 extending downward and outward as shown. Between hinge members 26*b* and 26*c* is simply the Lower surface 61 of the side wall 14, unlike the surface 46 between hinge member 26*b* and 26*a* (FIG. 6). Between the hinge receivers 28*b* and 28*c* is a convex cylindrical support surface 62, for abutting and supporting the lower surface 61 of the side wall 14. For assembling the side wall 14 to the base 12, the side wall 14 is positioned as shown in FIG. 9, approximately 10 degrees relative to the base 12. The radial projections 40 on the hinge pins 34 are then inserted through the openings 57 into the hinge receivers 28*b, c* to be positioned below the hinge retainers 50 as shown in FIG. 10. As can be seen in FIG. 10, the ribs 36 of each hinge member 26*b*, 26*c* are positioned on either side of the hinge retainer 50 for lateral stability.

Figure 11:
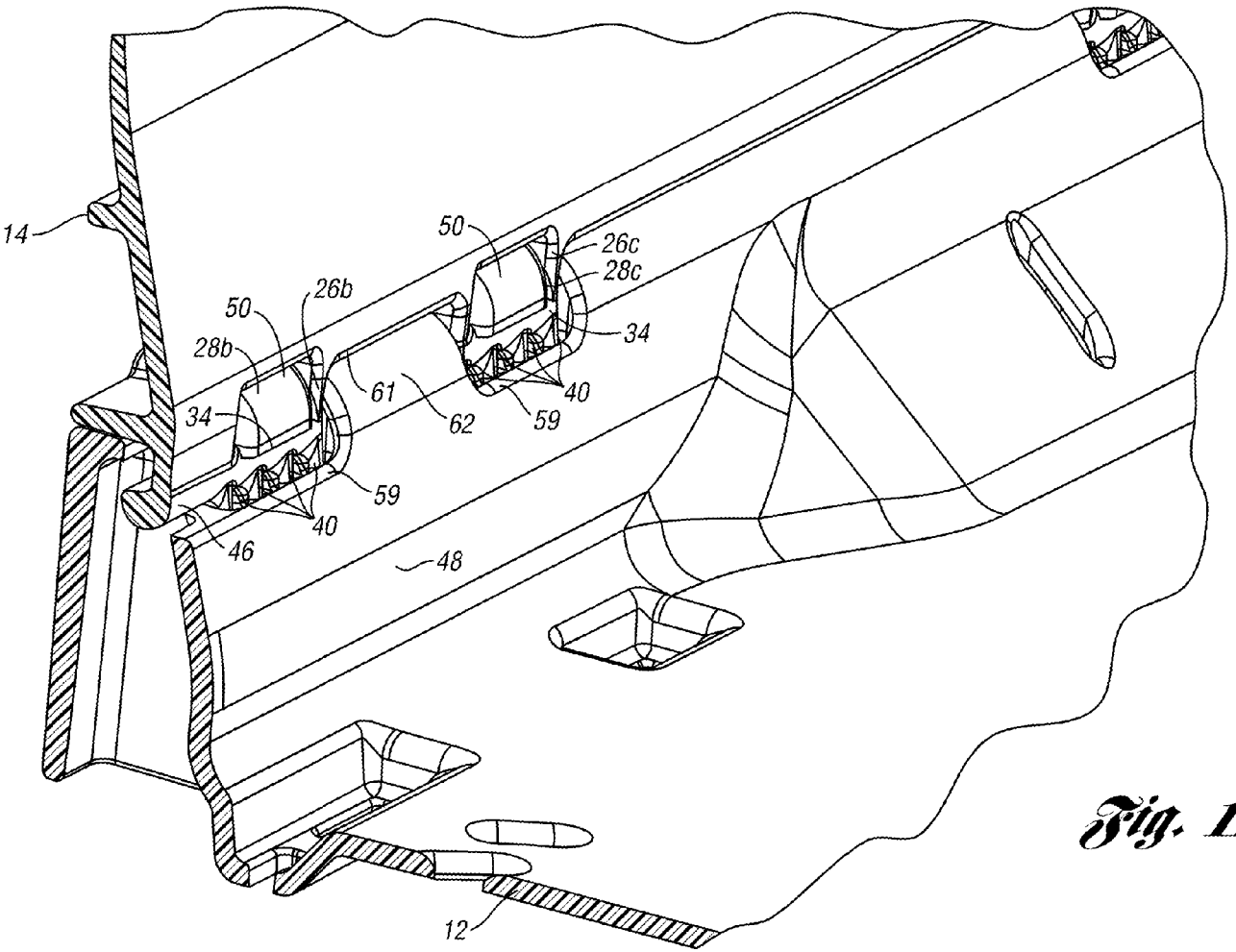
FIG. 11 is an interior perspective view of the hinge pins and hinge receivers of FIG. 9 with the side wall in the upright position.

When assembled, the side wall 14 is moveable about the hinges 20 to an upright, use position, generally perpendicular to base 12, as shown in FIG. 11. It is shown again in FIG. 11 that the radial projections 40 of the upper edge flange 48 prevent over rotation of the side wall 14 and prevent the hinge pins 34 from popping out of the hinge retainers 50 due to over rotation.

Figure 12:
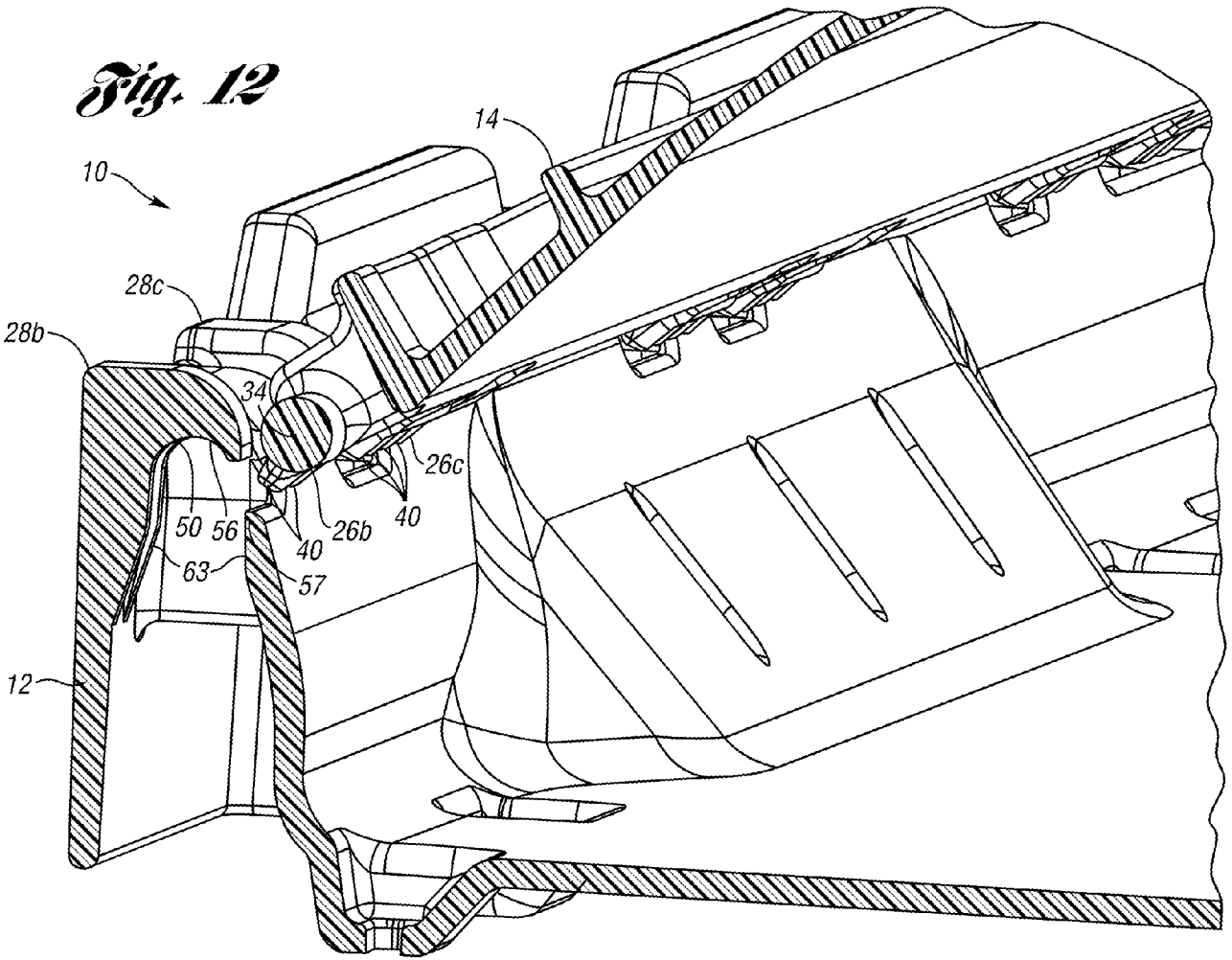
FIG. 12 is an interior perspective view of the hinge pins and hinge receivers of FIG. 9, partially broken away through one of the hinge pins and one of the hinge receivers.
Figure 13:
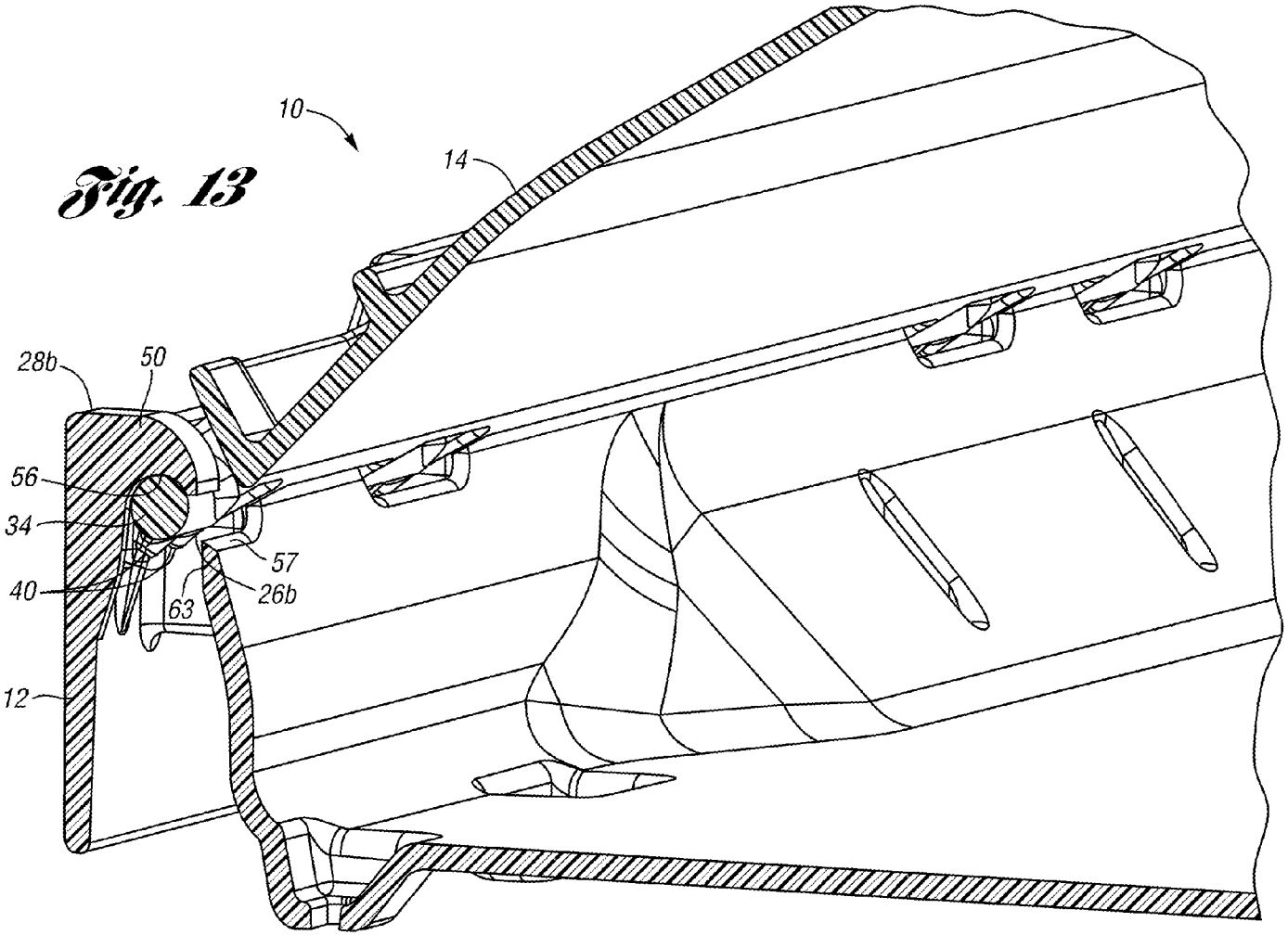
FIG. 13 illustrates the hinge pins and hinge receivers of FIG. 12, in the assembled position.

FIG. 12 is a perspective of the side wall 14 and base 12 and sectioned through the hinge member 26*b* and hinge receiver 28*b*. FIG. 12 shows the side wall 14 and base 12 in the unassembled position, with the side wall 14 rotated to the proper angle for insertion of the radial projections 40 through the openings 57 into the cavities 63 of the hinge receivers 28*b*, 28*c*. FIG. 13 shows the hinge pin 34 of the hinge member 26*b* received within the hinge retainer 50, with an upper convex, cylindrical surface of the hinge pin 34 rotatably abutting the convex upper surface 56 of the hinge retainer 50.

Figure 14:
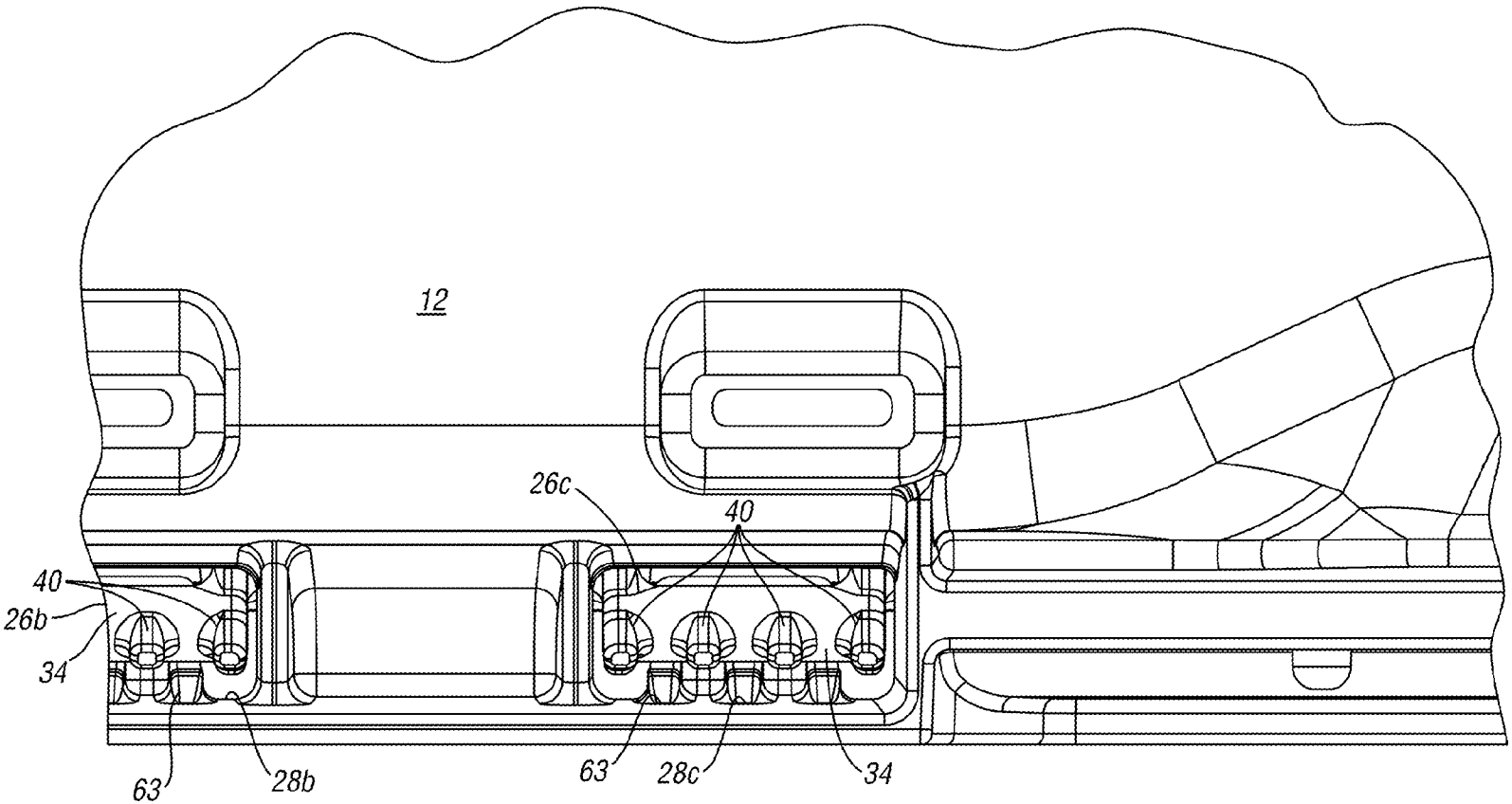
FIG. 14 is a bottom view of the hinge pins and hinge receivers.

FIG. 14 is a bottom view of the hinge members 26*b*, 26*c* and hinge receivers 28*b, c* of the collapsible container 10 of the present invention.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A collapsible crate comprising:

a base;

a side wall; and a hinge pivotably connecting the base to the side wall such that the side wall is pivotable between a first rotational position relative to the base and a second rotational position relative to the base, wherein the second rotational position is a use position where the side wall is generally perpendicular to the base, the first rotational position spaced in a first direction from the second rotational position, the hinge comprising a hinge member and a hinge receiver, the hinge member including a hinge pin having at least one radial projection, such that the hinge member is insertable into an opening in the hinge receiver when the side wall is in the first rotational position relative to the base, the opening in the hinge receiver opening generally toward the first direction, the radial projection preventing removal of the hinge pin from the hinge receiver in a radial direction when the side wall is in the second rotational position relative to the base.

2. The collapsible crate of claim 1 wherein:

the side wall is rotatable from the second rotational position through the first rotational position to a collapsed position generally parallel to the base.

3. The collapsible crate of claim 2 wherein the hinge pin is not removable from the hinge receiver when the side wall is in the collapsed position.

4. The collapsible crate of claim 1 wherein the hinge is one of a plurality of hinges connecting the side wall to the base.

5. The collapsible crate of claim 4 wherein a pair of the plurality of hinges include a convex support surface between the hinge pins of the hinge members, the base including a complementary support surface abutting the convex support surface.

6. The collapsible crate of claim 5 wherein the hinge pins of the pair of the plurality of hinges and the convex support surface form a continuous, generally cylindrical outer surface from which the projections extend.

7. The collapsible crate of claim 6 wherein each hinge receiver includes a retainer extending upwardly and inwardly to define the opening in the hinge receiver, the hinge member fitting into the opening when the side wall is in the first rotational position, the opening in the hinge receiver opening inwardly.

8. The collapsible crate of claim 7 wherein each hinge member includes a pair of ribs connected to the hinge pin and extending adjacent either side of the retainer.

9. The collapsible crate of claim 7 wherein the retainer extends into an opening between the hinge pin and the side wall.

10. The collapsible crate of claim 1 wherein the base includes an inner wall adjacent which is defined a cavity into which the at least one radial projection is received, the at least one radial projection abutting the inner wall when the side wall is pivoted to the second rotational position.

11. The collapsible crate of claim 10 wherein the at least one radial projection extends downwardly from the hinge pin into the cavity.

12. A collapsible crate comprising:

a base;

a plurality of side walls; and a plurality of hinges each pivotably connecting one of the side walls to the base such that the side wall is pivotable between a collapsed position generally parallel to the base and a use position generally perpendicular to the base, the hinge comprising a hinge member and a hinge receiver, the hinge member including a hinge pin having at least one radial projection, the hinge receiver including a wall adjacent which is defined a cavity into which the at least one radial projection is received, the hinge receiver including a retainer extending away from the hinge receiver and partially about the hinge pin and defining an opening between the retainer and the wall, the at least one radial projection abutting the wall when the side wall is pivoted to the use position.

13. The collapsible crate of claim 12 wherein the retainer is an inwardly opening retainer.

14. The collapsible crate of claim 13 wherein each hinge member includes a pair of ribs connected to the hinge pin and extending adjacent either side of the retainer.

15. The collapsible crate of claim 12 wherein the at least one radial projection includes a plurality of radial projections.

16. The collapsible crate of claim 12 wherein the hinge member includes at least one rib connecting the one of the side walls to the hinge pin, the at least one rib adjacent the retainer.

17. The collapsible crate of claim 16 wherein the at least one rib is angularly separated from the at least one radial projection relative to an axis of the hinge pin, the at least one radial projection extending radially from the axis of the hinge pin.

18. The collapsible crate of claim 12 wherein one of the wall and the retainer is spaced directly inwardly of the other relative to the container to define the opening.

19. A collapsible crate comprising:

a base;

a plurality of side walls; and a hinge pivotably connecting one of the side walls to the base such that the side wall is pivotable between a collapsed position and an upright use position, the hinge comprising a hinge member and a hinge receiver, the hinge member including a hinge pin having at least one portion of increased radial dimension, the hinge receiver having an opening into which the hinge pin is received, the opening defined between a retainer and an adjacent wall, the retainer extending partially about the hinge pin, wherein each hinge member includes a pair of ribs connected to the hinge pin and extending adjacent either side of the retainer when the side wall is in the use position, the portion of increased radial dimension being larger than the opening and aligned with the opening when the side wall is in the use position such that the hinge pin cannot be removed from the hinge receiver through the opening when the side wall is in the use position and such that the hinge pin can be removed through the opening when the side wall is in a first position between the use position and the collapsed position.

20. The collapsible crate of claim 19 wherein the portion of increased radial dimension extends substantially downwardly, away from the side wall when the side wall is in the upright position.

21. A collapsible crate comprising:

a base;

a plurality of side walls; and a hinge pivotably connecting one of the side walls to the base such that the side wall is pivotable between a collapsed position and an upright use position, the hinge comprising a hinge member and a hinge receiver, the hinge member including a hinge pin having at least one portion of increased radial dimension, wherein the portion of increased radial dimension includes a plurality of radial projections, the hinge receiver having an opening into which the hinge pin is received, the opening defined between a retainer and an adjacent wall, the retainer extending partially about the hinge pin, the portion of increased radial dimension being larger than the opening and aligned with the opening when the side wall is in the use position such that the hinge pin cannot be removed from the hinge receiver through the opening when the side wall is in the use position and such that the hinge pin can be removed through the opening when the side wall is in a first position between the use position and the collapsed position.

22. A collapsible crate comprising:

a base;

a plurality of side walls; and a hinge pivotably connecting one of the side walls to the base such that the side wall is pivotable between a collapsed position and an upright use position, the hinge comprising a hinge member and a hinge receiver, the hinge member including a hinge pin having at least one portion of increased radial dimension, 'the hinge receiver having an opening into which the hinge pin is received, the opening defined between a retainer and an adjacent wall, the retainer extending partially about the hinge pin, the portion of increased radial dimension being larger than the opening and aligned with the opening when the side wall is in the use position such that the hinge pin cannot be removed from the hinge receiver through the opening when the side wall is in the use position and such that the hinge pin can be removed through the opening when the side wall is in a first position between the use position and the collapsed position, wherein the hinge member includes at least one rib connecting the one of the side walls to the hinge pin, the at least one rib adjacent the retainer, the at least one rib angularly spaced from the portion of increased radial dimension.

* * * * *